US009691571B2

(12) United States Patent
Liao et al.

(10) Patent No.: US 9,691,571 B2
(45) Date of Patent: Jun. 27, 2017

(54) ELECTRONIC DEVICE WITH METALLIC BUTTON

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Qian-Long Liao, Shenzhen (CN); Cong-Cong Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 77 days.

(21) Appl. No.: 14/715,185

(22) Filed: May 18, 2015

(65) Prior Publication Data

US 2016/0217944 A1 Jul. 28, 2016

(30) Foreign Application Priority Data

Jan. 22, 2015 (CN) ..... 2015 1 0031892

(51) Int. Cl.
*H01H 23/06* (2006.01)
*H01H 13/14* (2006.01)

(52) U.S. Cl.
CPC ..... *H01H 13/14* (2013.01); *H01H 23/06* (2013.01); *H01H 2221/058* (2013.01); *H01H 2223/008* (2013.01); *H01H 2229/046* (2013.01)

(58) Field of Classification Search
CPC ..... H01H 13/06; H01H 2223/002; H01H 13/063; H01H 13/86; H01H 23/06
USPC ..... 200/302.1, 302.2, 344, 345
See application file for complete search history.

(56) References Cited

U.S. PATENT DOCUMENTS 9,240,292 B1 * 1/2016 Lapetina ..... H01H 9/04
2011/0056817 A1 * 3/2011 Wu ..... H01H 13/14 200/344
2015/0027868 A1 * 1/2015 Gao ..... H01H 13/063 200/341
2015/0041297 A1 * 2/2015 Fan ..... H01H 13/14 200/345

FOREIGN PATENT DOCUMENTS

TW I397092 B 5/2013
TW M471669 U 2/2014

* cited by examiner

*Primary Examiner* — Edwin A. Leon
*Assistant Examiner* — Ahmed Saeed
(74) *Attorney, Agent, or Firm* — Steven Reiss

(57) ABSTRACT

An electronic device includes a housing and a button. The housing has a first surface and a second surface opposite to the first surface, and defines a mounting hole passing through the first surface and the second surface. The mounting hole has an inner surface. The button is received in the mounting hole, and includes a metallic keycap and an annular buffer member. The keycap has a peripheral side surface, and defines a receiving groove on the peripheral side surface which extends around the peripheral side surface. The buffer member is composed of flexible material, sleeved on the keycap cap, partially received in the mounting hole, and partially positioned outside of the mounting hole to resist the second surface of the housing.

8 Claims, 4 Drawing Sheets

ELECTRONIC DEVICE WITH METALLIC BUTTON

FIELD

The subject matter herein generally relates to electronic devices and in particular to an electronic device with a metallic button.

BACKGROUND

Electronic devices such as cell phones often include a number of mechanical buttons.

BRIEF DESCRIPTION OF THE DRAWINGS

Implementations of the present technology will now be described, by way of example only, with reference to the attached figures.

DETAILED DESCRIPTION

Figure 1:
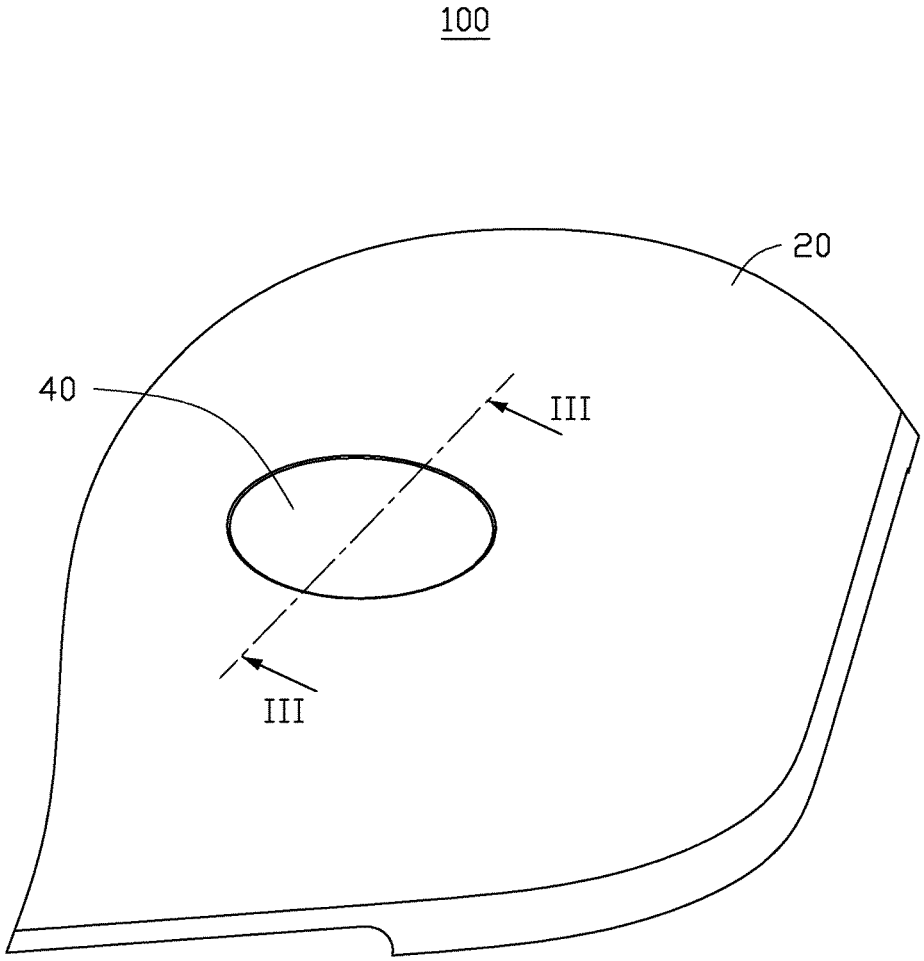
FIG. 1 is a partial, isometric view of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "outside" refers to a region that is beyond the outermost confines of a physical object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

An electronic device can include a housing and a button. The housing can have a first surface and a second surface opposite to the first surface, and a mounting hole passing through the first surface and the second surface. The mounting hole can have an inner surface. The button can be mounted in the mounting hole, and include a metallic keycap and an annular buffer member. The keycap can have a peripheral side surface, and define a receiving groove on the peripheral side surface which extends around the entirety of the peripheral side surface. The buffer member can be composed of flexible material, sleeved on the keycap, partially received in the mounting hole, and partially positioned outside of the mounting hole. A side surface of parts of the annular buffer member which are positioned outside of the mounting hole can resist the second surface of the housing to separate the keycap from the housing.

FIG. 1 illustrates an embodiment of an electronic device 100. The electronic device 100 can include a housing 20, and a button 40 mounted on the housing 20. The electronic device 100 further includes other functional elements (not shown) well known in the art, such as a printed circuit board. The electronic device 100 can be a cell phone, a tablet computer, a television, and so on.

Figure 2:
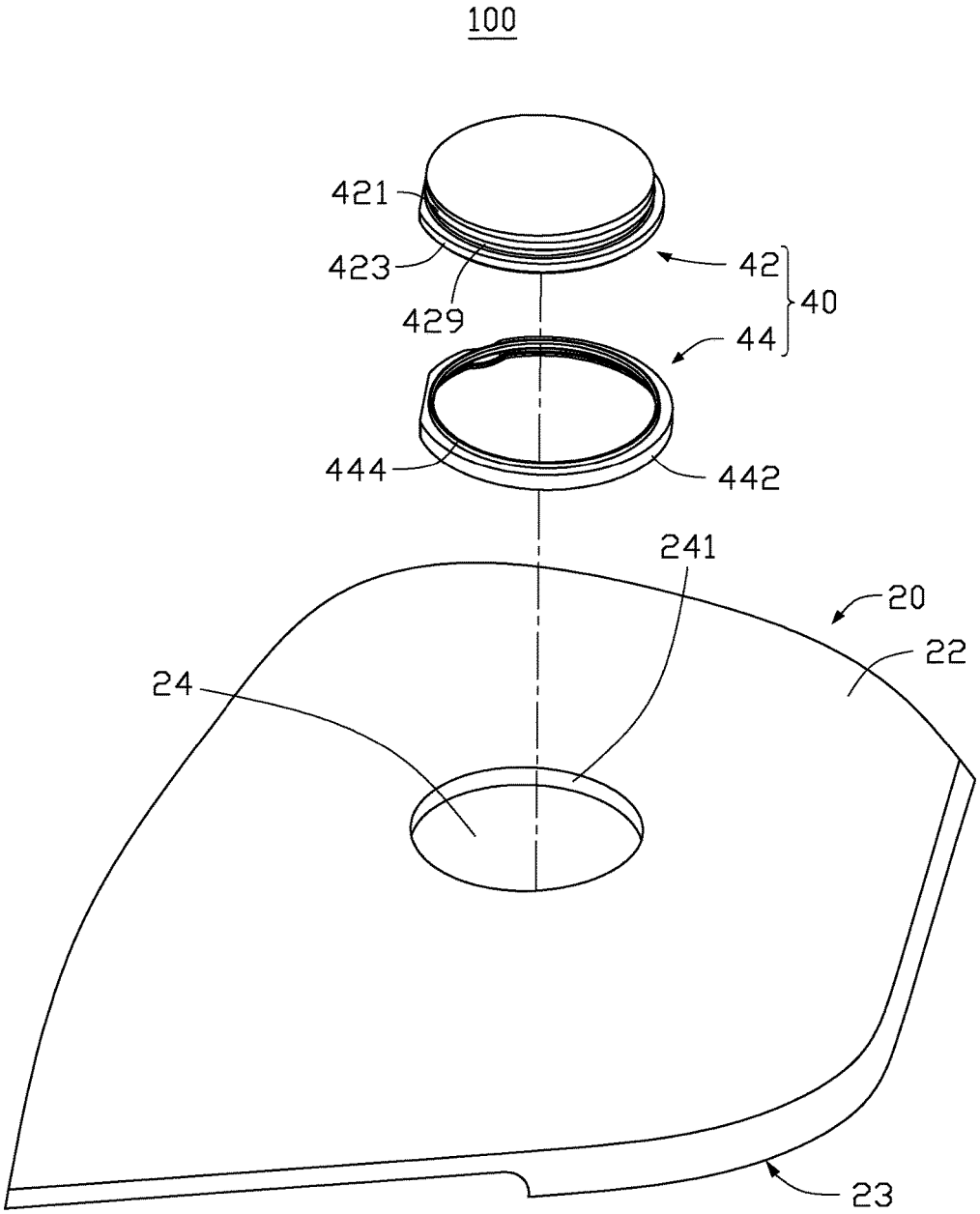
FIG. 2 is an exploded, isometric view of the electronic device of FIG. 1.
Figure 3:
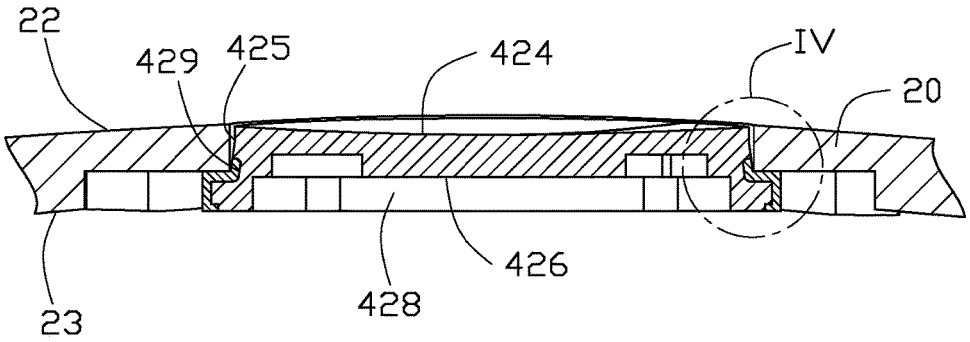
FIG. 3 is a cross-sectional view of the electronic device of FIG. 3, taken along lien III-III of FIG. 1.

FIGS. 2 and 3 illustrate that the housing 20 can be substantially plate shaped. The housing 20 can include a first surface 22, and a second surface 23 opposite to the first surface 22. The housing 20 can define a mounting hole 24 passing through the first surface 22 and the second surface 23. The mounting hole 24 can have an inner surface 241, and can be configured to receive the button 40. In at least one embodiment, the housing 20 can be composed of metal.

Figure 4:
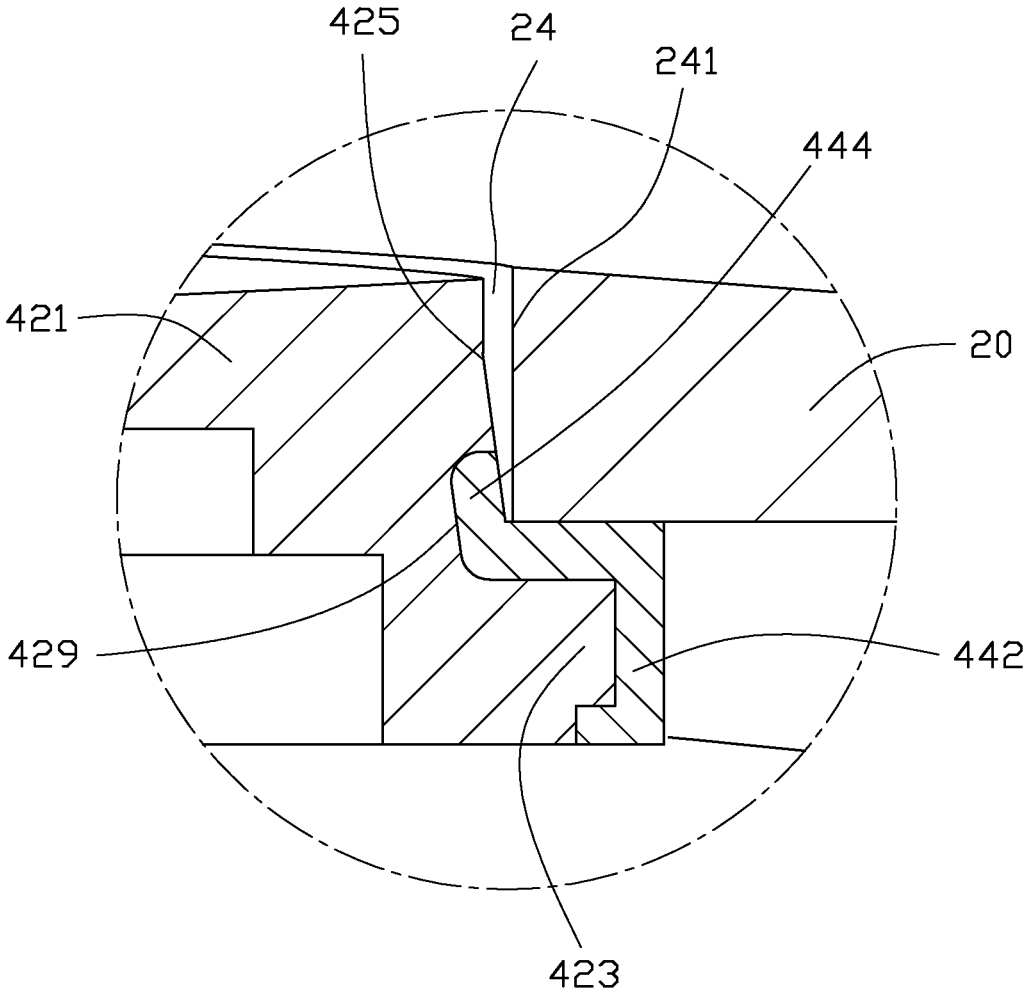
FIG. 4 is an enlarged view of the circle portion IV of FIG. 3.

FIGS. 2 to 4 illustrate that the button 40 can include a keycap 42 and a buffer member 44. The keycap 42 can be substantially cylindrical, and can include a pressing portion 421 and a protrusion portion 423. The pressing portion 421 can be substantially cylindrical, and received in the mounting hole 24, to move along the central axis of the mounting hole 24 within the mounting hole 24. A diameter of the pressing portion 421 can be slightly less than that of the mounting hole 24, thus the pressing portion 421 can move smoothly in the mounting hole 24. The pressing portion 421 can include a pressing surface 424, a mounting surface 426 opposite to the pressing surface 424, and a peripheral side surface 425 interconnecting the pressing surface 424 and the mounting surface 426. The pressing surface 424 can sink from an end of the peripheral side surface 425 toward the center of the pressing portion 421. The pressing portion 421 can define a mounting groove 428 on the mounting surface 426. The mounting groove 428 can be configured to receive electrical components of the electronic device 100, and can communicate with the mounting hole 24. The pressing portion 421 can define a receiving groove 429 on the peripheral side surface 425. The receiving groove 429 can extend around the central axis of the pressing portion 421.

The protrusion portion 423 can protrude from the peripheral side surface 425 of the pressing portion 421 adjacent to the receiving groove 429. One side surface of the protrusion portion 423 can align with one side surface of the receiving groove 429. The protrusion portion 423 can extend around the central axis of the pressing portion 421, and can be positioned outside of the mounting hole 24.

The buffer member 44 can be substantially annular, and can include a buffer portion 442 and a connecting portion 444. The buffer portion 442 can be substantially annular. The buffer portion 442 can be sleeved on the protrusion portion 423 and can resist the second surface 23 of the housing 20 to separate the keycap 42 from the housing 20. The buffer portion 442 can support the housing 20. The connecting portion 444 can extend from an end of the buffer portion 442 to be received in the receiving groove 429, and can align with the peripheral side surface 425 of the pressing portion 421 of the key cap 42. The buffer member 40 can be composed of flexible material, such as silica gel, and rubber.

In at least one embodiment, the keycap 42 can be composed of metal, such as aluminum, and aluminum alloy; the buffer member 44 can be composed of silica gel; and the buffer member 44 can be integrated with the keycap 42 with a compression molding method. Unlike injection molding, compression molding can prevent the anodic oxide film coated on the surface of the keycap 42 from breaking under high temperature.

After the button 40 is assembled on the housing 10, a distance can be defined between the inner surface 241 of the mounting hole 24 and the peripheral side surface 425 of the pressing portion 421, and the distance can be gradually decreased from the end of the inner surface 241 adjacent to the first surface 22 toward the end of the inner surface 241 adjacent to the second surface 23. Thus, the button 40 can move smoothly in the mounting hole 24. In at least one embodiment, the distance between the end of the inner surface 241 of the mounting hole 24 adjacent to the second surface 23 and the corresponding peripheral side surface 425 of the keycap 42 can be about 0.024 millimeters, and the distance between the end of the inner surface 241 of the mounting hole 24 adjacent to the first surface 22 and the corresponding peripheral side surface 425 of the keycap 42 can be about 0.15 millimeters. During testing, the housing 20 can be shook, and the inner surface of the mounting hole 24 can touch or rub the connecting portion 444 of the buffer member 44, but not the peripheral side surface 425 of the keycap 42. Because the metallic keycap 42 does not touch or rub the metallic housing 20, the metallic keycap 42 cannot resonate with the metallic housing 20. Thus, noise cannot be produced from resonance during testing.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. An electronic device comprising:

a housing having a first surface and a second surface opposite to the first surface, and having a mounting hole passing through the first surface and the second surface, the mounting hole having an inner surface; and a button mounted in the mounting hole, the button comprising:

a metallic keycap comprising a pressing portion with a peripheral side surface, the pressing portion defining a receiving groove recessing from the peripheral side surface which extends around an entirety of the peripheral side surface, and an annular buffer member composed of flexible material, sleeved on the keycap, partially received in the mounting hole, and partially positioned outside of the mounting hole, a portion of a side surface of the annular buffer member positioned outside of the mounting hole abuts against the second surface of the housing to separate the keycap from the housing;

wherein the buffer member comprises a connecting portion positioned in the receiving groove, and an outer surface of the connecting portion is aligned with the peripheral side surface.

2. The electronic device of claim 1, wherein a predetermined distance is defined between the inner surface of the mounting hole and the peripheral side surface of the keycap.

3. The electronic device of claim 2, wherein the distance between the inner surface of the mounting hole and the peripheral side surface of the keycap is gradually decreased from a first end of the inner surface adjacent to the first surface toward a second end of the inner surface adjacent to the second surface.

4. The electronic device of claim 1, wherein the keycap comprises:

a protrusion portion protruding from the peripheral side surface, and positioned outside of the mounting hole; and wherein the buffer member is fitted over the protrusion portion.

5. The electronic device of claim 4, wherein the buffer member comprises:

a buffer portion covering the protrusion portion and abutting against the second surface of the housing to separate the keycap from the housing; and the connecting portion protruding from an end of the buffer portion.

6. The electronic device of claim 4, wherein the pressing portion further comprises:

a pressing surface sinking from the peripheral of the pressing portion toward the center of the pressing portion; and a mounting surface opposite to the pressing surface;

the peripheral side surface interconnects the pressing surface and the mounting surface.

7. The electronic device of claim 6, wherein a mounting groove is defined on the mounting surface and adjacent to the mounting hole.

8. The electronic device of claim 1, wherein the buffer member is composed of silica gel or rubber.

* * * * *